US006032635A

United States Patent [19]

Moorman et al.

[11] Patent Number: 6,032,635

[45] **Date of Patent: *Mar. 7, 2000**

[54] OVERHEAD CAM ENGINE WITH INTEGRAL HEAD

[75] Inventors: James W. Moorman, Kiel; Erik J. Christiansen, Cedarburg, both of Wis.; Roberto Molina, Turin, Italy; Gar M. Adams, Elkhart Lake, Wis.

[73] Assignee: Tecumseh Products Company, Tecumseh, Mich.

[ * ] Notice: This patent is subject to a terminal disclaimer.

[21] Appl. No.: 09/286,636

[22] Filed: Apr. 2, 1999

Related U.S. Application Data

[60] Continuation of application No. 09/047,246, Mar. 24, 1998, which is a division of application No. 08/673,100, Jul. 1, 1996, Pat. No. 5,755,194.

[51] Int. Cl.[7] ..... F01M 1/00

[52] U.S. Cl. ..... 123/196 R; 123/196 CP

[58] Field of Search ..... 123/196 R, 196 CP, 123/196 W

[56] References Cited

U.S. PATENT DOCUMENTS

| | | | |
|---|---|---|---|
| Re. 21,031 | 3/1939 | Schenk | 184/6 |
| Re. 32,620 | 3/1988 | Iwai | 440/77 |
| 1,024,727 | 4/1912 | Huff . | |
| 1,112,536 | 10/1914 | Huff . | |
| 1,191,246 | 7/1916 | Tillotson . | |
| 1,291,839 | 1/1919 | Gorham . | |
| 1,339,497 | 5/1920 | Church . | |
| 1,384,873 | 7/1921 | Strickland . | |
| 1,470,769 | 10/1923 | Shaw . | |
| 1,575,359 | 3/1926 | Nutt . | |
| 1,799,271 | 4/1931 | Woolson . | |
| 1,845,136 | 2/1932 | Dieter . | |
| 1,910,375 | 5/1933 | Woolson . | |
| 2,000,714 | 5/1935 | Nutt | 184/6 |
| 2,235,160 | 6/1941 | Ljungstrom | 123/192 |
| 2,306,554 | 12/1942 | Morehouse | 184/6 |
| 2,324,373 | 6/1943 | Dusevoir | 74/598 |
| 2,346,207 | 4/1944 | Brown | 123/65 |
| 2,458,051 | 1/1949 | Bosma | 123/196 |
| 2,496,434 | 2/1950 | Bosma | 184/6 |
| 2,700,964 | 2/1955 | Nallinger | 123/41.77 |
| 2,752,213 | 6/1956 | Swart | 309/10 |
| 2,857,903 | 10/1958 | Watkins | 123/196 |

(List continued on next page.)

FOREIGN PATENT DOCUMENTS 63-147906 6/1988 Japan .

*Primary Examiner*—John Kwon
*Attorney, Agent, or Firm*—Baker & Daniels

[57] ABSTRACT

A single cylinder, internal combustion engine with a dry sump lubrication system. The engine includes an engine housing in which the overhead camshaft and crankshaft are rotatably supported, and the housing includes an integrally formed cylinder and head. A timing belt disposed externally of the engine housing interconnects the crankshaft and camshaft, and a piston connected to the crankshaft reciprocates within an internal bore provided in the engine housing cylinder. The cylinder wall around the internal bore is of a generally uniform thickness and circumscribed by cooling fins such that the cylinder resists bore distortion during operation. Dry sump lubrication is obtained by an external oil reservoir connected to a pump which supplies pressurized oil to the bearing journals of the camshaft. A portion of the oil at the camshaft bearing journals flows through passages provided within the cylinder to lubricate the bearing journals of the crankshaft. The reciprocating motion of the valve assemblies controlling intake and exhaust of the combustion chamber pumps the oil which lubricated the camshaft back to the external reservoir. The reciprocating motion of the piston similarly effects a high pressure within the crankcase cavity to pump oil which has lubricated the crankshaft back to the external reservoir. The inventive engine further provides for the mounting of flywheels within the crankcase cavity in conjunction with an external, lightweight fan for engine housing cooling, as well as employs a cast in valve seat for the overhead valve assemblies.

4 Claims, 7 Drawing Sheets

U.S. PATENT DOCUMENTS

| | | | |
|---|---|---|---|
| 3,037,582 | 6/1962 | Egloff | 184/6 |
| 3,042,146 | 6/1962 | Shimanckas | 184/6 |
| 3,044,238 | 7/1962 | Harkness | 56/25.4 |
| 3,144,095 | 8/1964 | Trapp | 184/6 |
| 3,195,526 | 7/1965 | Jordan | 123/73 |
| 3,331,364 | 7/1967 | Chariatte | 123/196 |
| 3,416,295 | 12/1968 | Kaufman | 56/25.4 |
| 3,418,993 | 12/1968 | Scheiterlein | 123/195 |
| 3,523,592 | 8/1970 | Fenton | 184/6 |
| 3,669,082 | 6/1972 | Hatz | 123/41.65 |
| 3,687,231 | 8/1972 | Scheiterlein | 184/6.5 |
| 3,691,914 | 9/1972 | Reisacher | 92/169 |
| 3,983,852 | 10/1976 | Chatourel | 123/41.69 |
| 4,372,258 | 2/1983 | Iwai | 123/73 |
| 4,433,655 | 2/1984 | Villella | 123/196 |
| 4,446,828 | 5/1984 | Bauder | 123/196 |
| 4,466,409 | 8/1984 | Asaka | 123/433 |
| 4,475,488 | 10/1984 | Odashima | 123/73 |
| 4,493,661 | 1/1985 | Iwai | 440/77 |
| 4,523,556 | 6/1985 | Suzuki | 123/196 |
| 4,570,584 | 2/1986 | Uetsuji | 123/179 |
| 4,570,586 | 2/1986 | Roe | 123/192 |
| 4,579,093 | 4/1986 | Eanes | 123/65 |
| 4,606,304 | 8/1986 | Kruger | 123/90.27 |
| 4,641,546 | 2/1987 | Mettler | 74/598 |
| 4,727,834 | 3/1988 | Isaka | 123/196 |
| 4,766,859 | 8/1988 | Mijaki | 123/196 |
| 4,773,884 | 9/1988 | Matsumoto | 440/88 |
| 4,805,565 | 2/1989 | Ssato | 123/90.6 |
| 4,881,510 | 11/1989 | Etoh | 123/572 |
| 4,903,654 | 2/1990 | Sato | 123/196 |
| 4,911,119 | 3/1990 | Ohno | 123/196 |
| 4,982,705 | 1/1991 | Hudson | 123/41.65 |
| 4,984,539 | 1/1991 | Shinoda | 123/41.42 |
| 5,090,375 | 2/1992 | Hudson | 123/196 |
| 5,143,033 | 9/1992 | Catterson | 123/195 |
| 5,176,116 | 1/1993 | Imagawa | 123/196 |
| 5,193,500 | 3/1993 | Haft | 123/196 CP |
| 5,213,074 | 5/1993 | Imagawa | 123/196 |
| 5,230,795 | 7/1993 | Mitchell | 264/318 |
| 5,241,932 | 9/1993 | Everts | 123/195 |
| 5,243,937 | 9/1993 | Imagawa | 123/195 |
| 5,293,847 | 3/1994 | Hoffman | 123/90.6 |
| 5,347,967 | 9/1994 | Todero | 123/317 |
| 5,447,127 | 9/1995 | Luck et al. | 123/90.33 |
| 5,524,581 | 6/1996 | Rush, II et al. | 123/196 R |
| 5,606,943 | 3/1997 | Tamba et al. | 123/196 W |
| 5,687,688 | 11/1997 | Tsunoda et al. | 123/196 W |
| 5,755,194 | 5/1998 | Moorman et al. | 123/196 W |
| 5,778,848 | 7/1998 | Takahashi et al. | 123/196 W |

OVERHEAD CAM ENGINE WITH INTEGRAL HEAD

This is a continuation of application Ser. No. 09/047,246, filed Mar. 24, 1998, which is a divisional of application Ser. No. 08/673,100, filed Jul. 1, 1996, U.S. Pat. No. 5,755,194,

BACKGROUND OF THE INVENTION

The present invention pertains to a portable engine, and, in particular, to a single cylinder internal combustion engine of the size and type adapted for use in power equipment such as that used in lawn and garden, general utility and snow removal operations. Such equipment includes but is not limited to lawnmowers, snow throwers, generators, string trimmers, leaf blowers, ice augers, earth movers, etc.

A variety of portable engines which are relatively lightweight have been employed with outdoor or lawn and garden power equipment such as lawnmowers, string trimmers and the like. While both four cycle and two cycle engine designs have previously been utilized, four cycle engines have generally emerged as the preferred design from the standpoint of reducing exhaust and noise emissions. In particular, recent legislation has reduced allowable exhaust emission levels to a point where the engine must be carefully designed to comply with promulgated emission levels, and four cycle engines typically burn cleaner than two cycle engines.

One shortcoming of some commercially available four cycle engines that undesirably leads to higher emissions relates to their propensity to distort in shape. As the engine heats up during usage, the thermal expansion of the engine cylinder block components may produce bore distortions which allow leakage, such as lubricating oil, to pass the piston rings and pollute the engine exhaust. In particular, due to weight and space restrictions inherent in the utilization of these portable engines, and in order to accommodate other mechanical workings of the engines such as drive components for an overhead camshaft, the cylinder bore wall thickness may vary markedly around the bore perimeter. In addition, the walls may be less rigid than optimal because a thin inner wall must be provided to separate multiple internal chambers. In addition, reinforcing ribbing may be withheld due to spacing requirements. These wall thickness variations and lack of rigidity may result in a non-uniform expansion or distorting of the cylinder bore during combustion pressure and thermal cycling, and consequently an unclean engine combustion may occur. A further consequence of such distortion producing leakage is to form oil-based deposits in the combustion chamber. It is well known that these deposits are an important source of the emission of volatile organic compounds, a critical constituent in the control of exhaust emissions. Build-up of these deposits over time is the main contributor to the deterioration of the control of exhaust emissions over the useful life of an engine.

Another potential source of cylinder bore distortion stems from the use of a separate head and cylinder. When a cylinder head is fastened to the cylinder block, the point loading around the cylinder bore which occurs with head bolt torquing may create sufficient bore distortion to compromise the seal with the piston. The head gasket normally introduced between the cylinder and head creates additional bore distortion concerns. For example, because the head gasket serves as a heat transfer barrier and thereby does not uniformly distribute the heat energy over the cooling surfaces of the engine, distortion potential of the cylinder bore associated with thermal expansion may be exacerbated.

Another shortcoming of some existing single cylinder engines relates to their lubrication system. Many engines depend on a continual splashing of the lubricant collected in the sump to lubricate the moving engine components. This splashing technique is not entirely satisfactory as it tends to be less reliable in thoroughness than pressurized lubrication. Further, because splash-type lubrication demands that the engine remain in a designed-for orientation to ensure the oil splashers extend into the collected lubricant, the orientations at which the engine can operate may be limited, thereby hindering engine applications. In other systems, a pump immersed in the lubricant collected in the crankcase sump distributes that lubricant around the engine. In addition to having a limited range of engine orientations at which a given pump will function, this configuration has several disadvantages. For example, a separate pump is required which may increase the engine weight, engine cost and be inconvenient to access for servicing. In addition, the amount of oil is limited by the crankcase volume. Still other engines which use a dry sump lubrication system require an additional pump mechanism to pump the sump contents to a reservoir, and this additional pump adds undesirable weight and cost.

The need for flywheels introduces other problems in portable engines. Due to space constraints, flywheels are typically mounted on the crankshaft at a position external of the engine housing and in a cantilevered fashion. To support this cantilevered flywheel mass without failure, the crankshaft must be formed with a stronger shaft than would be required without an external flywheel. Regardless of whether this stronger shaft is obtained by using a stronger material or by providing a larger diameter shaft, the overall weight of the engine is likely to be increased, and the ease of portability of the engine is thereby diminished. In addition, flywheels are frequently formed separately from the crankshaft and then rotatably fixed together via keying. Unfortunately, during aggressive or emergency stopping which can occur by accident or by use of braking devices, the inertia of the flywheel can lead to breakage of the key between the crankshaft and the flywheel, which renders the engine nonoperational.

Thus, it is desirable to provide a small internal combustion engine which overcomes these and other disadvantages of prior art engines.

SUMMARY OF THE INVENTION

The present invention provides a single cylinder, four cycle overhead cam engine designed to satisfy existing emission standards while still providing a lightweight construction convenient for applications such as lawnmowers and handheld devices. The uniform wall thickness and reinforcing ribs incorporated into the engine cylinder block reduces bore distortions which precipitate an unclean operation. The dry sump lubrication system employed eliminates the need for an extra pump, which would undesirably add weight to the engine, to lift oil used to lubricate the engine parts back to a reservoir for recirculation. This unique means of providing "free" lift pumps saves both weight and cost. By mounting the engine flywheels internally of the engine housing and introducing a lightweight fan on the crankshaft externally of the housing, the inventive engine can be formed with a lighter crankshaft but still be provided with a cooling air flow over the engine housing.

The invention, in one form thereof, is a single cylinder, four stroke cycle, overhead cam engine having an engine block that includes an integrally formed cylinder and cylinder head and having a crankshaft cavity and a crankcase cavity, an interconnected crankshaft, connecting rod and piston disposed in the crankcase cavity, and a camshaft and belt assembly disposed in said camshaft cavity.

A pair of valve stem bores extend through the block between the camshaft and crankcase cavities, the valve assembly including valve stems disposed in the stem bores. There are no further internal passages in the block extending between the camshaft and crankcase cavities. Along the axial segment of the cylinder wall in which the piston reciprocates, the wall has a substantially uniform thickness around substantially all of the wall circumference.

In accordance with another form of the invention, the engine comprises an engine housing including a cylinder and a cylinder head wherein the cylinder defines an internal bore. A crankshaft is disposed within the housing and extends externally thereof and a piston is operably connected to the crankshaft and mounted for reciprication within the bore. A camshaft is disposed within the housing and is operably connected to the crankshaft, and a valve assembly is operably connected with the camshaft for regulating inlet to and exhaust from the cylinder bore. A lubricant reservoir is located external to the engine housing and lubricant is supplied from the reservoir to the camshaft by means of a pump that includes a mechanism for returning lubricant used to lubricate the camshaft within the engine back to the external reservoir by means of a pumping action produced by shifting of said valve assembly to force lubricant through a conduit to the reservoir.

One advantage of the engine of the present invention is that the substantially uniform wall thickness of the cylinder reduces the possibility of bore distortion likely to cause undesirable emissions.

Another advantage of the present invention is that cooling fins completely encircling the cylinder increase the rigidity of the cylinder and thereby reduce the possibility of bore distortion.

Another advantage of the present invention is that the integral cylinder and cylinder head eliminates the need for a head gasket as well as elimination of distortion producing fasteners between the cylinder head and cylinder block.

Another advantage of the present invention is that a pressurized lubricating system provides a reliable lubrication at a variety of engine orientations.

Another advantage of the present invention is that a dry sump lubrication system is provided which does not require an additional pump to convey oil from the sump to an external reservoir. In addition, the dry sump lubrication system provides increased flexibility of engine orientation.

Another advantage of the present invention is that the camshaft can be conveniently molded in one-piece from a non-metallic material which generates less noise during operation than many metal camshafts. In addition, this camshaft design is much lighter in weight than metallic camshafts, and requires no machining after molding.

Another advantage of the present invention is that the one-piece molded camshaft can be provided with an inner rotor of a gerotor pump mechanism to reduce the number of component pieces of the engine.

Still another advantage of the present invention is that the flywheel is located within the crankcase and not cantilevered externally of the crankcase, thereby allowing the use of less strong crankshafts and smaller bearings, thus reducing weight and friction.

Still another advantage of the present invention is that the flywheel may be formed integrally with the crankshaft, thereby allowing for design of a lighter crankshaft from less costly materials. This allows weight and cost savings as well as allowing for drastic braking of the crankshaft without risk of the flywheel breaking free from the crankshaft.

Still another advantage of the present invention is that a plastic fan mounted on the crankshaft can be used to effectively cool the engine without adding excessive weight.

Still another advantage of the present invention is that the overhead valve seat can be cast in place during cylinder block casting, thereby eliminating the need to machine the cylinder head for receipt of the valve seat. This reduces cost as well as eliminating a common reliability problem caused by pressed-in seats falling out during operation.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
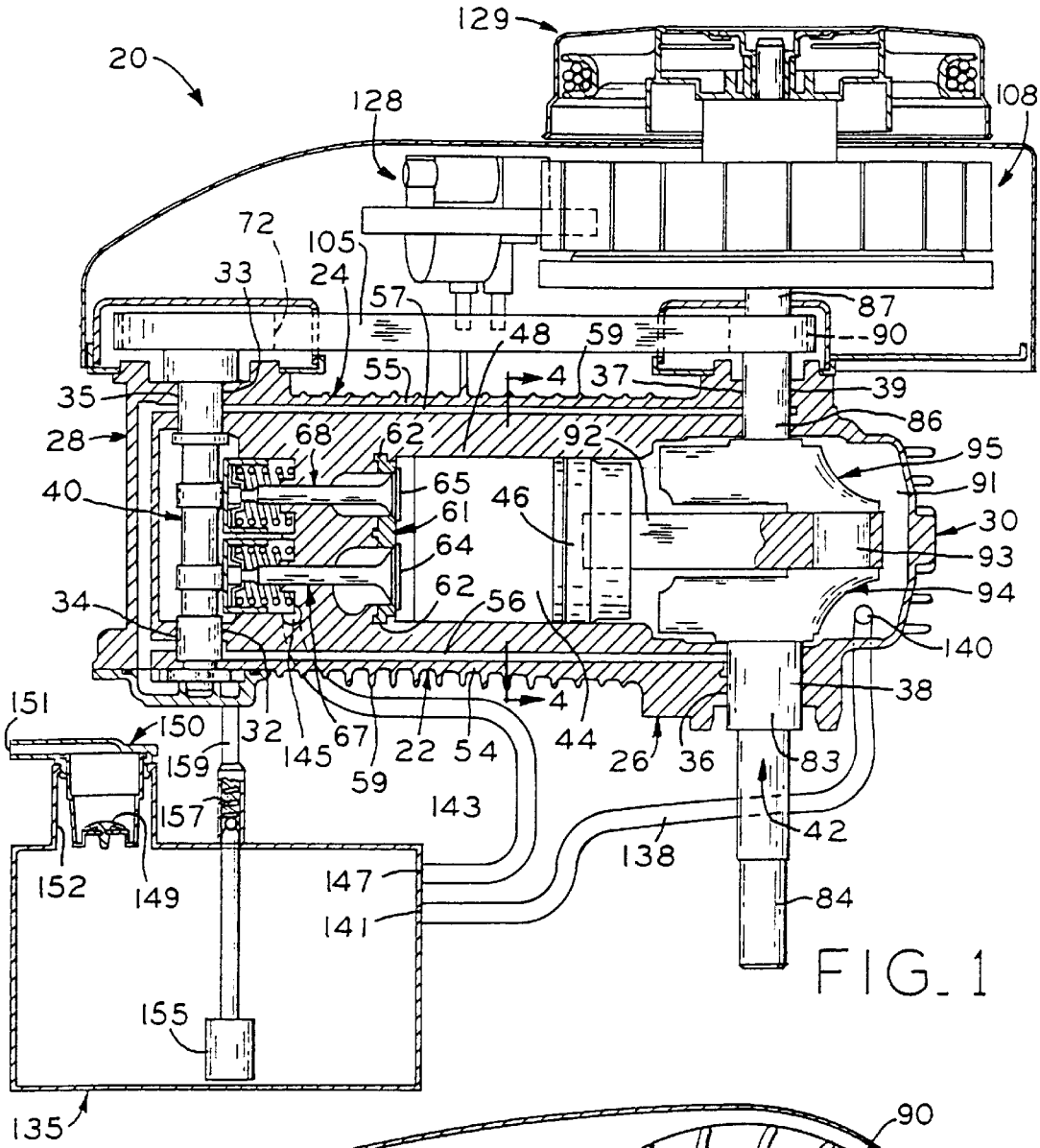
FIG. 1 is a diagrammatic vertical view in partial cross-section of an internal combustion engine configured according to the principles of the present invention.

Corresponding reference characters indicate corresponding parts throughout the several views. Although the drawings represent embodiments of the invention, the drawings are not necessarily to scale and certain features may be exaggerated in order to better illustrate and explain the present invention.

DESCRIPTION OF THE PREFERRED EMBODIMENTS

The embodiments disclosed below are not intended to be exhaustive or limit the invention to the precise forms disclosed in the following detailed description.

Referring to FIG. 1, there is diagrammatically shown a vertical crankshaft type internal combustion engine, generally designated 20, configured in accordance with the present invention. While the shown vertical crankshaft orientation finds beneficial application in a variety of devices including lawnmowers, engine 20 could be otherwise arranged and oriented, for example with a horizontally oriented crankshaft or any angle inbetween, within the scope of the invention.

Figure 3:
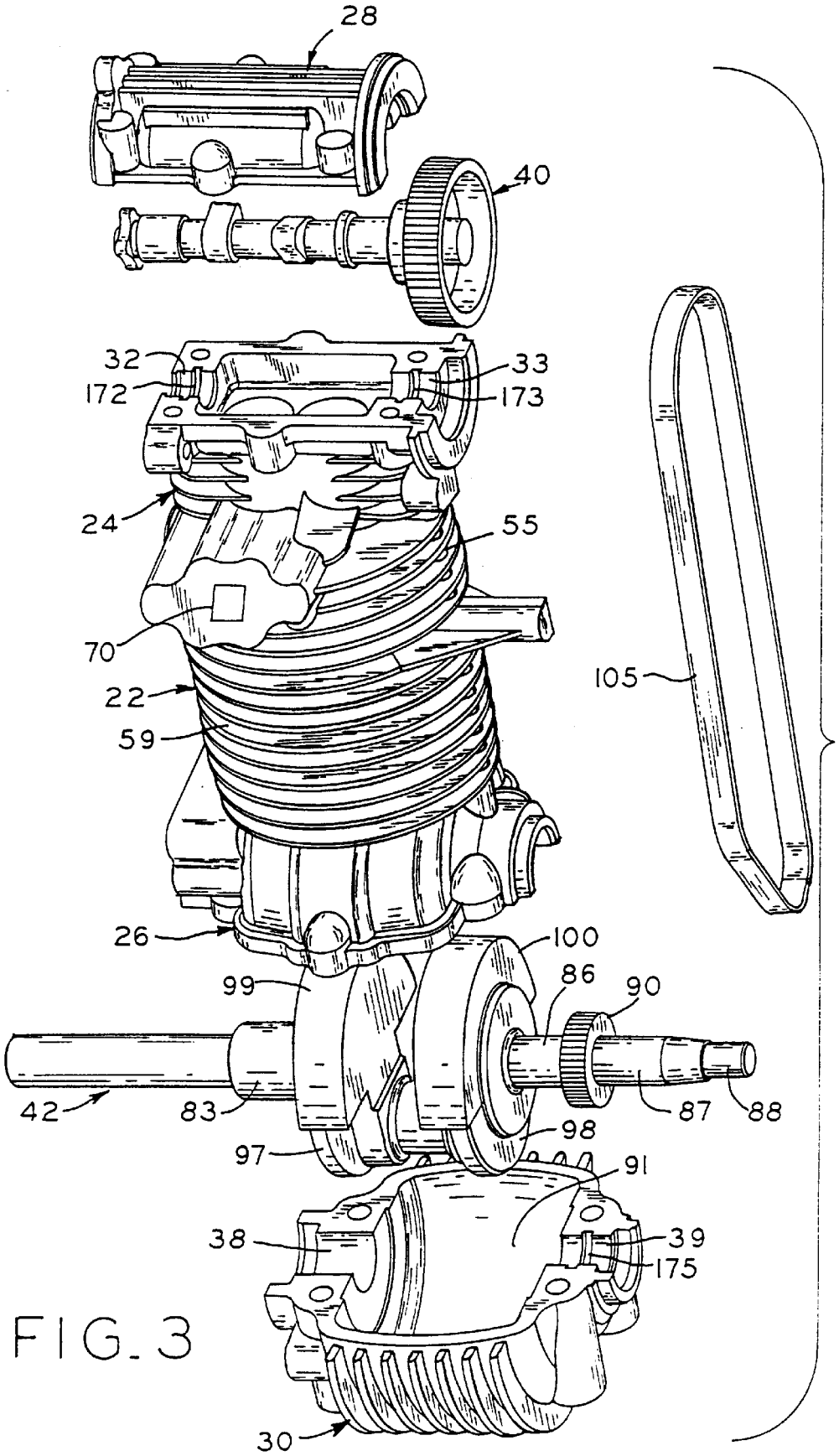
FIG. 3 is an exploded view of selected portions of the engine of FIG. 1, namely the cam cover, cylinder block, crankcase cover, camshaft, crankshaft, and timing belt.

As shown in FIG. 1, and with additional reference to the perspective view of FIG. 3, the housing of engine 20 is formed in part by a cylinder block including a central cylinder 22 integrally formed with both cylinder head 24 and an upper crankcase skirt 26. The cylinder block is a one-piece die casting which is cast from a lightweight material, such as aluminum, and then machined to a final shape. The engine housing also includes die cast cam cover 28 and crankcase cover 30 respectively secured to cylinder head 24 and crankcase skirt 26 with suitable fasteners such as bolts (not shown). Cylinder head 24 and cam cover 28 include cooperating journal bearings 32, 33, 34 and 35 upon which an overhead camshaft, generally designated 40, is rotatably supported. At their interface, crankcase skirt 26 and crankcase cover 30 similarly include cooperating journal bearings 36, 37 and 38, 39 for the crankshaft, generally designated 42. Journal bearings 32–39 may be integrally formed with their respective engine housings as shown, or could be otherwise provided within the scope of the invention.

Figure 4:
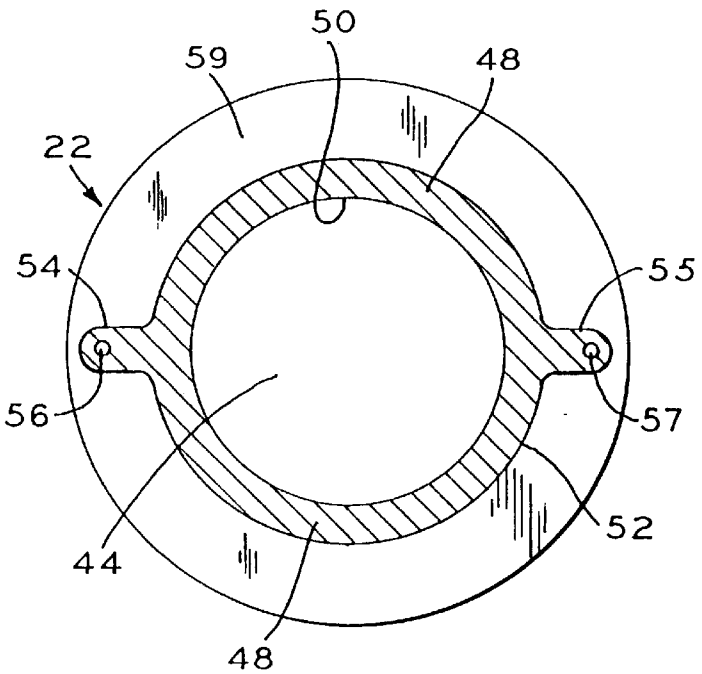
FIG. 4 is a cross-sectional view, taken along line 4—4 of FIG. 1, showing the generally uniform wall thickness of the cylinder.

Cylinder 22 is provided with a cylindrical axial bore 44 in which a die cast elliptical barrel-faced piston 46 with associated rings translates in a reciprocating fashion during operation. The volume within bore 44 between piston 46 and cylinder head 24 serves as a combustion chamber for engine 20. Along at least the axial segment of the cylinder bore 44 in which piston 46 slides during reciprocating strokes, cylinder 22 is substantially symmetrical about the axis of the piston stroke. This symmetry advantageously results in a more uniform thermal expansion of cylinder 22 in the radial direction during use that reduces cylinder bore distortion. For example, as shown in FIG. 4, which is a transverse cross-section taken along line 4—4 of FIG. 1, cylinder 22 is formed of a single, generally ring-shaped wall 48 having an inner radial periphery 50 defining bore 44. The outer radial periphery 52 of wall 48 is exposed to allow passing air to draw off heat generated during combustion within bore 44. Except for two radially projecting bosses 54, 55 spaced 180° apart and through which pass symmetrical axially-extending lubrication conduits 56, 57 drilled therethrough, wall 48 is exactly ring-shaped. Wall 48 has a substantially uniform thickness in the range of 0.180" to 0.250", and preferably a thickness of about 0.180". As best shown in FIG. 4, circumscribing cylinder 22 and radially projecting therefrom are a series of axially spaced, annular cooling fins 59. Fins 59 are uniformly shaped along the length of cylinder 22. In addition to providing an increased surface area for dissipating heat, cooling fins 59 act as stiffening ribs for cylinder 22 that add rigidity which further hinders bore distortion.

With direction in reference to the stroke of piston 46 relative to crankshaft 42, at the top of cylinder bore 44 is a one-piece valve seat 61 provided within cylinder head 24. Valve seat 61 seats the valve heads 64, 65 of exhaust and inlet poppet valve assemblies 67, 68. Valve seat 61 is a net shape insert, preferably preformed from a powdered metal composition such as Zenith sintered product no. F0008-30, which is cast in cylinder head 24. In particular, after valve seat 61 is inserted into the cylinder block die, the die is closed and the casting of the block occurs. Raised plateau sections 62 that laterally and upwardly project from opposite side edges of valve seat 61 permit the molten aluminum injected into the closed die to mold around the raised sections 62 to maintain valve seat 61 in position. It will be recognized that no machining is required to insert valve seat 61 into the cylinder block with this cast-in insertion technique. Alternately shaped and arranged modules, including recesses provided within valve seat 61, that provide similar securing functions as raised plateau sections 62 could naturally be substituted within the scope of the invention.

Figure 5:
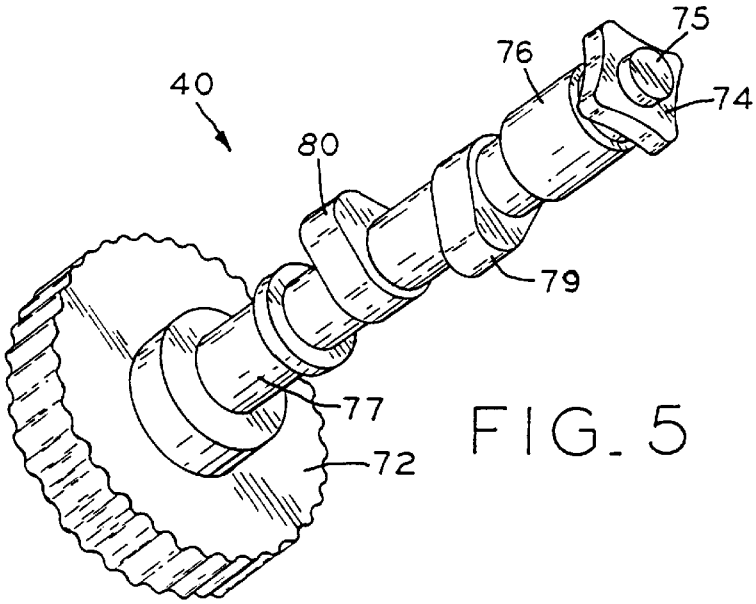
FIG. 5 is a perspective view of the one-piece camshaft of the engine of FIG. 1.

Valve assemblies 67, 68, which control flow communication between the combustion chamber 44 and the inlet port 70 (See FIG. 3) and the exhaust port (not shown) in the cylinder block, or vice versa, may be of traditional design and are selectively engaged during the four stroke engine cycle by overhead camshaft 40. Suitable seals (not shown) prevent lubricant introduced within the camshaft cavity region from reaching bore 44. As further shown in FIG. 5, camshaft 40 includes a cam sprocket 72 such as a notched pulley at one axial end, a gerotor pump inner rotor 74 with pilot 75 at the opposite axial end, intermediate journal sections 76, 77 that rotate within bearings 32–35, and cam lobes 79, 80 that directly actuate separate valve assemblies 67, 68. Camshaft 40 is preferably formed in one-piece from a lightweight thermoset or thermoplastic material, such as Fiberite FM-4017 F. This plastic material tends to produce less noise during engagement with valve assemblies 67, 68 and bearings 32–35 than do standard metal materials. This material further allows ready provision of precisely designed shapes requiring little or no machining while achieving a low weight. Alternative camshaft constructions, including an assembly of component parts made from various materials, may also be employed.

Aligned parallel to camshaft 40 is crankshaft 42, which is diagrammatically shown in FIG. 1. Crankshaft 42 is formed from cast ferrous material such as ductile iron and includes a lower shaft portion including a journal section 83 and a stub shaft 84 which outwardly extends from the engine housing for power take off to drive, for example, a lawnmower blade. The upper shaft portion of crankshaft 42 includes journal section 86, a shaft segment 87, and an upper stub shaft 88 (see FIG. 3). A sintered metal drive sprocket 90 such as a pulley with a notched outer periphery is axially inserted over shaft segment 87 and is attached for rotation therewith via a tapered key (not shown). Between bearing journals 83, 86 and housed within the crankcase cavity 91 defined by crankcase cover 30 and crankcase skirt 26, crankshaft 42 includes a pair of counterweight/flywheel members 94, 95. Members 94, 95 are preferably integrally formed with journal sections 83, 86, respectively, and are interconnected by a spanning crank pin 93. A two-piece extruded or cast connecting rod 92 is pivotally attached to piston 46 with a wrist pin (not shown) and is rotatably supported on crank pin 93. In an alternative embodiment the connecting rod may be of one piece construction. The wrist pin can be secured with conventional retainers or alternatively with plastic inserts at either end of the axially floating wrist pin which engage the cylinder bore wall and the opposite ends of the wrist pin.

As best shown in FIG. 3, counterweight/flywheel members 94, 95 include disc-shaped flywheel portions 97, 98 axially centered on crankshaft 42. Flywheel portions 97, 98 function as a conventional flywheel to provide all the rotational inertia to crankshaft 42 necessary to even out crankshaft rotation during the four cycle operation and to maintain crankshaft rotation during the piston strokes other than the power stroke. Counterweight/flywheel members 94, 95 further include counterweight portions 99, 100 at the same axial locations along crankshaft 42 as flywheel portions 97, 98. While in the shown configuration part of the flywheel portions 97, 98 and counterweight portions 99, 100 are merged together, the portions could have an alternative arrangement, such as an axially stacked arrangement within cavity 91. The placement of flywheel portions 97, 98 within cavity 91 and in close proximity to the journal bearings 36–39 avoids the use of a large cantilevered mass outside the engine housing which cannot be perfectly balanced and thus creates unwanted torsional forces on the crankshaft. In addition, bending and shear stresses are also imparted to the crankshaft.

Figure 6:
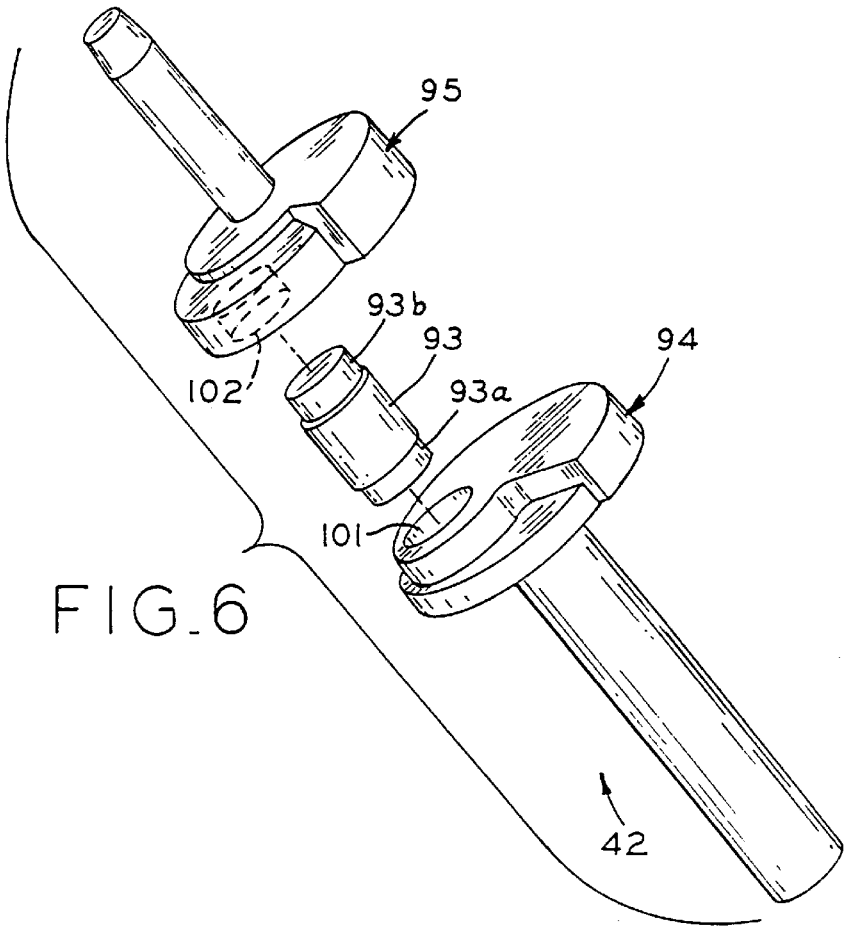
FIG. 6 is an abstract perspective view of one embodiment of a crankshaft in a disassembled condition.

As represented in the abstract perspective view of FIG. 6, crankshaft 42 can be fashioned by forming counterweight/flywheel members 94, 95 integral with the upper and lower shaft portions respectively. Crankshaft 42 is completed by providing a crank pin 93 having cylindrical plugs 93*a*, 93*b* insertable into cooperatively shaped recesses 101, 102 provided in members 94, 95. An alternative to the shown configuration of a stepped crank pin would be a straight pin.

Figure 2:
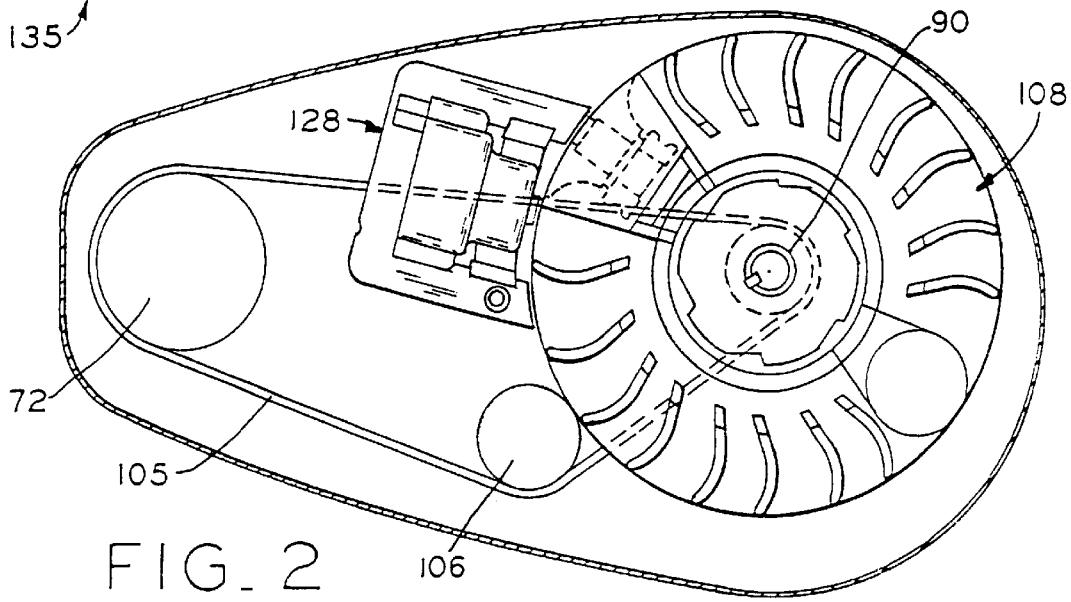
FIG. 2 is a diagrammatic plan view of the engine of FIG. 1, wherein portions have been removed to better illustrate the interconnection of the camshaft and crankshaft externally of the cylinder block via the timing belt.

Referring again to FIG. 1, drive sprocket 90 and cam sprocket 72 are preferably interconnected by an endless loop driver, such as a chain or timing belt, mounted externally of the engine housing. Timing belt 105 shown effects the transmission of rotational motion from crankshaft 42 to camshaft 40 and achieves the timed relation therebetween necessary for proper engine operation. Flexible timing belt 105, which includes notches on its inner or outer surface oriented perpendicular to the direction of belt travel, also passes over idler pulley 106, which is abstractly shown in FIG. 2. Idler pulley 106 is a non-spring loaded, adjustable sealed ball bearing mounted on an eccentric, but may also be of other conventional constructions, including spring loaded for automatic adjustment. A governor (not shown) of a suitable construction may be axially mounted on idler pulley 106 or cam sprocket 72 to regulate the engine speed. By mounting a governor at such a location, the governor can be positioned in close proximity to the carburetor, and also need not be associated with leak-prone sealed rods projecting from the crankcase. The governor may also be of a commonly known air vane type.

Figure 7:
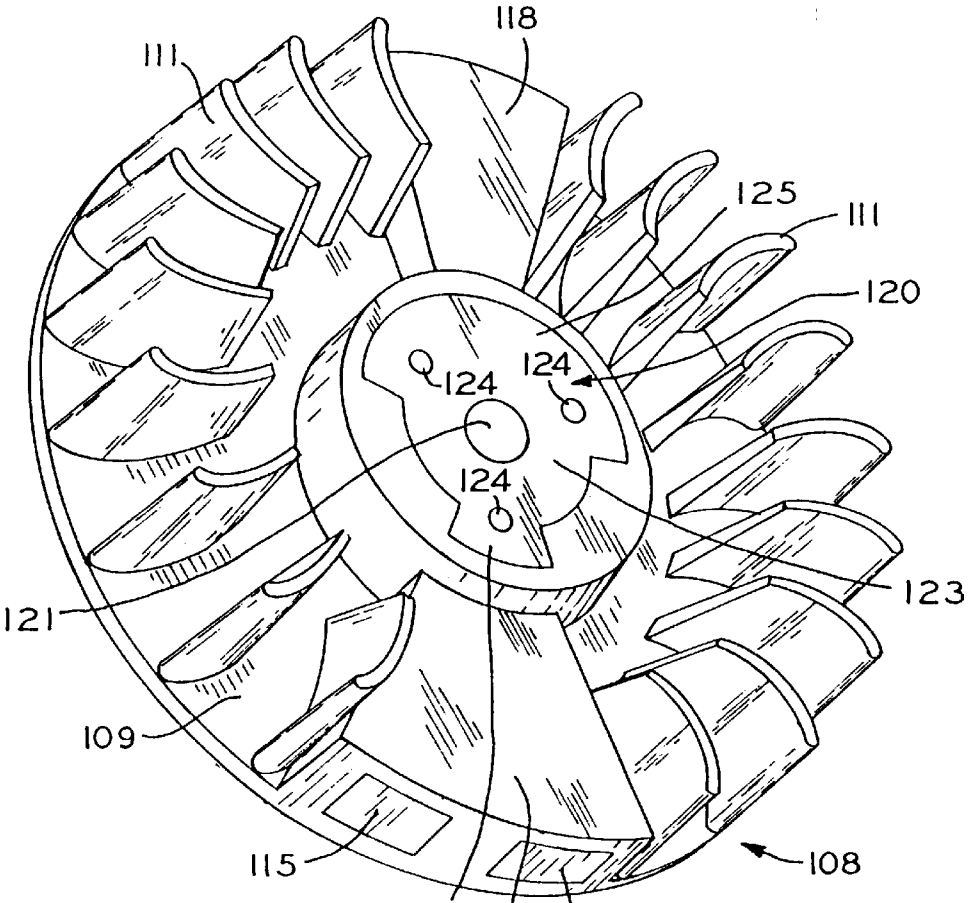
FIG. 7 is a perspective view of the crankshaft mounted fan of the engine of FIG. 1.

Mounted to upper stub shaft 88 is a lightweight centrifugal-type fan 108 utilized to force cooling air over the housing of engine 20. Fan 108 may be constructed with minimal mass as it is not intended to provide the rotational inertia already provided by flywheel portions 97, 98. As a result, the moment produced on the crankshaft is relatively minor. As further shown in the perspective view of FIG. 7, fan 108 includes a disc-shaped body 109 molded from thermoset or UV modified thermoplastic with blades 111 for air circulation. Body 109 includes a raised spoke 113 having an outer radial periphery into which ignition magnets 115, 116 are molded. Magnets 115, 116 cooperate with engine ignition system 128 mounted to the engine housing 22 to generate sparking within the combustion chamber that initiates internal combustion. Fan body 109 further includes counterweight 118 which balances the weight of magnets 115, 116 and spoke 113, and counterweight 118 may include a metal insert molded therein. Molded into the center of body 109 is a relatively sturdy, multi-lobed aluminum insert 120 which functions in the shown embodiment as both a mounting hub for fan 108 and a starter cup. In particular, mounting hub/starter cup insert 120 includes axial bore 121 which receives stub shaft 88 and is attached for rotation therewith via a tapered key (not shown). In outer surface 123, mounting hub/starter cup 120 includes recesses 124 structured for engagement with the pawls (not shown) of recoil starter 129 which descend when starter 129 is utilized. Radial lobes 125, 126 shown in FIG. 7 define angular gaps therebetween filled with molded plastic to prevent insert 120 from separating from fan body 109 during starting. As the precise construction of ignition system 128 and recoil starter 129 are not material to the present invention and can be one of a variety of well known types, further explanation is not provided herein. In situations where an electric starter sccompanies or replaces recoil starter 129, a grooved ring (not shown) preferably integrally formed in the bottom surface of fan body 109 may be utilized for engaging a starter pinion. Although plastic is preferred from a weight standpoint, other materials including aluminum may be used to form fan body 109. In an alternative embodiment (not shown) using commonly known alternative ignition means, the fan 108 may be of a simpler construction with additional cooling blades replacing spoke 113, magnets 115, 116 and counterweight 118. This simpler, lighter, more efficient fan would be fastened to a stub shaft (not shown) with simpler fasteners, such as intregrally molded clips or simple rivets. In this alternative the recoil starter hub may be separately attached or integrally molded to the fan.

Referring again to FIG. 1, engine 20 is preferably kept lubricated with a dry sump pressurized lubrication system that allows for multi-positional operation. The system includes an oil reservoir 135 mounted externally of and to the engine housing. Although shown at an elevation below the engine housing, reservoir 135 could be positioned above the balance of engine 20 without compromising the lubrication system operation. Oil reservoir 135 may be formed of a durable transparent plastic material such as nylon 6.6 thermoplastic, and with appropriate indicia to allow a visual determination of oil level. A first oil return conduit 138 formed of flexible tubing with a 0.125"–0.500" internal diameter extends between a crankcase outlet 140, namely a housing bore opening into crankcase cavity 91, and a reservoir inlet 141 opening into oil reservoir 135 above the collected lubricant. A second similarly constructed oil return conduit 143 with a 0.125"–0.500" internal diameter communicates with an outlet 145 and reservoir inlet 147. Outlet 145 is a bore, drilled through cylinder head 24, which opens into the head cavity 180, shown in FIG. 8, in which the biasing components of valve assembly 67 are housed. Return conduits 138 and 143 circulate the oil delivered to crankshaft 42 and overhead camshaft 40 respectively as described further below.

An abstractly shown breather/filler cap 150 securely fits over an inlet 152 through which replacement oil can be poured into reservoir 135. Breather 150 is a conventional filter-type assembly that includes check valve 149 allows one-way air flow out of reservoir 135, while preventing oil passage. Breather 150 includes an air exhaust port 151 which may be connected in flow communication with air intake port 70 on the carburetor air filter (not shown) or with the carburetor (not shown). The particular construction of breather 150 is not material to the invention and may be one of many suitable designs known in the art. Rather than being formed into the inlet cap, breather 150 could instead be integrated into a wall of reservoir 135 removed from inlet 152. Oil pick-up 155 includes an oil filter submerged within the volume of oil maintained in reservoir 135 and connects to a 0.125"–0.500" internal diameter supply conduit 159 leading to the lubrication system pump mechanism used to pressurize the oil introduced into engine 20. Oil pick-up 155 may be constructed of flexible tubing with a weighted inlet end to cause it to remain submerged within the reservoir fluid when the engine is tilted from a standard orientation. Check valve 157 is of a standard construction and is located within conduit 159 to permit one way flow of oil from reservoir 135. Oil reservoir 135 may also be mounted directly to oil pump 161 in certain orientations (not shown) which precludes the need for supply conduit 159 and check valve 157

Figure 8:
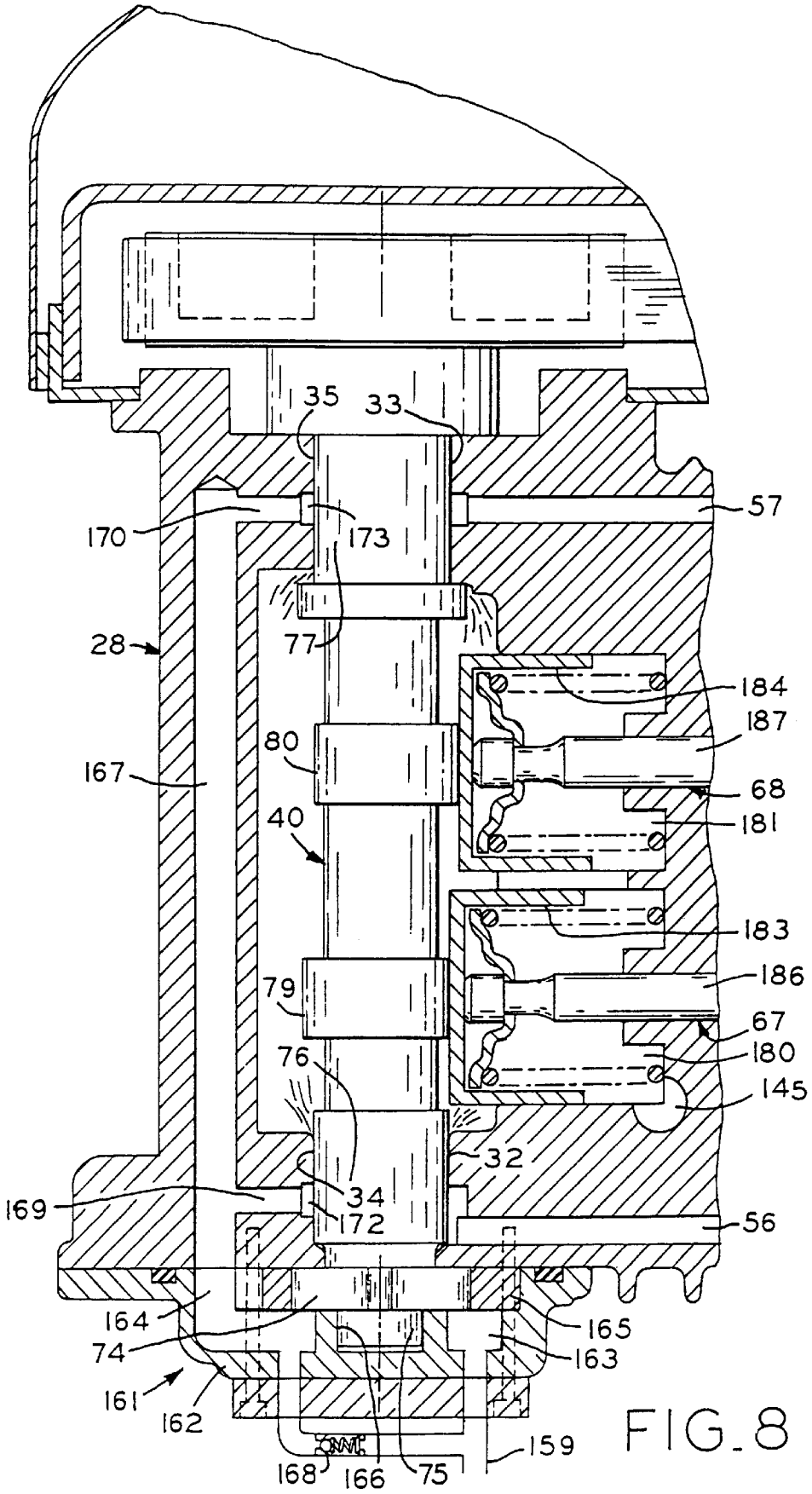
FIG. 8 is an enlarged view of that portion of the lubrication system shown in FIG. 1 utilized to lubricate the camshaft region of the engine.

The configuration of the pressurized lubrication system will be further explained with reference to FIGS. 8 and 9, which respectively show enlarged views of the engine parts used to lubricate camshaft 40 and crankshaft 42. The preferred pump mechanism fed by supply conduit 159 is a gerotor type pump which operates in a known manner. In the shown embodiment, the pump is generally designated 161 and utilizes the rotation of camshaft 40 to perform the pumping operations. Alternate types of pumps, including those which are separate from the remaining working components of engine 20, may be used to drive the lubrication system within the scope of the invention. The pump 161 includes a thermoset plastic cover plate 162, attached to the engine housing with bolts and an O-ring seal (not shown). A pressed metal or plastic outer rotor 165, which is retained by plate 162 and cooperatively shaped with inner rotor 74 of camshaft 40 to effect fluid pressurization is also included. Camshaft hub 75 is provided with bearing surfaces 166 in cover plate 162. Pump inlet port 163 communicates with the downstream end of oil supply conduit 159. Pressurized oil that is outlet at port 164 is forced into bore 167 within cam cover 28. A pressure relief valve 168 returns high pressure oil from port 164 to inlet port 163 to prevent excessive pressure. Cross bores 169, 170 distribute oil within bore 167 to annular grooves 172, 173 which are provided in bearings 32, 34 and 33, 35 respectively and which ring journals 76, 77. At their upstream ends, oil conduits 56, 57 open into grooves 172, 173 to allow oil communication therebetween. Conduits 56, 57 extend through cylinder head 24 and cylinder 22 toward crankshaft 42. Conduits 56, 57 are shown being parallel to bore 44, and consequently bosses 54, 55 radially project a uniform distance along the axial length of cylinder 22.

Figure 9:
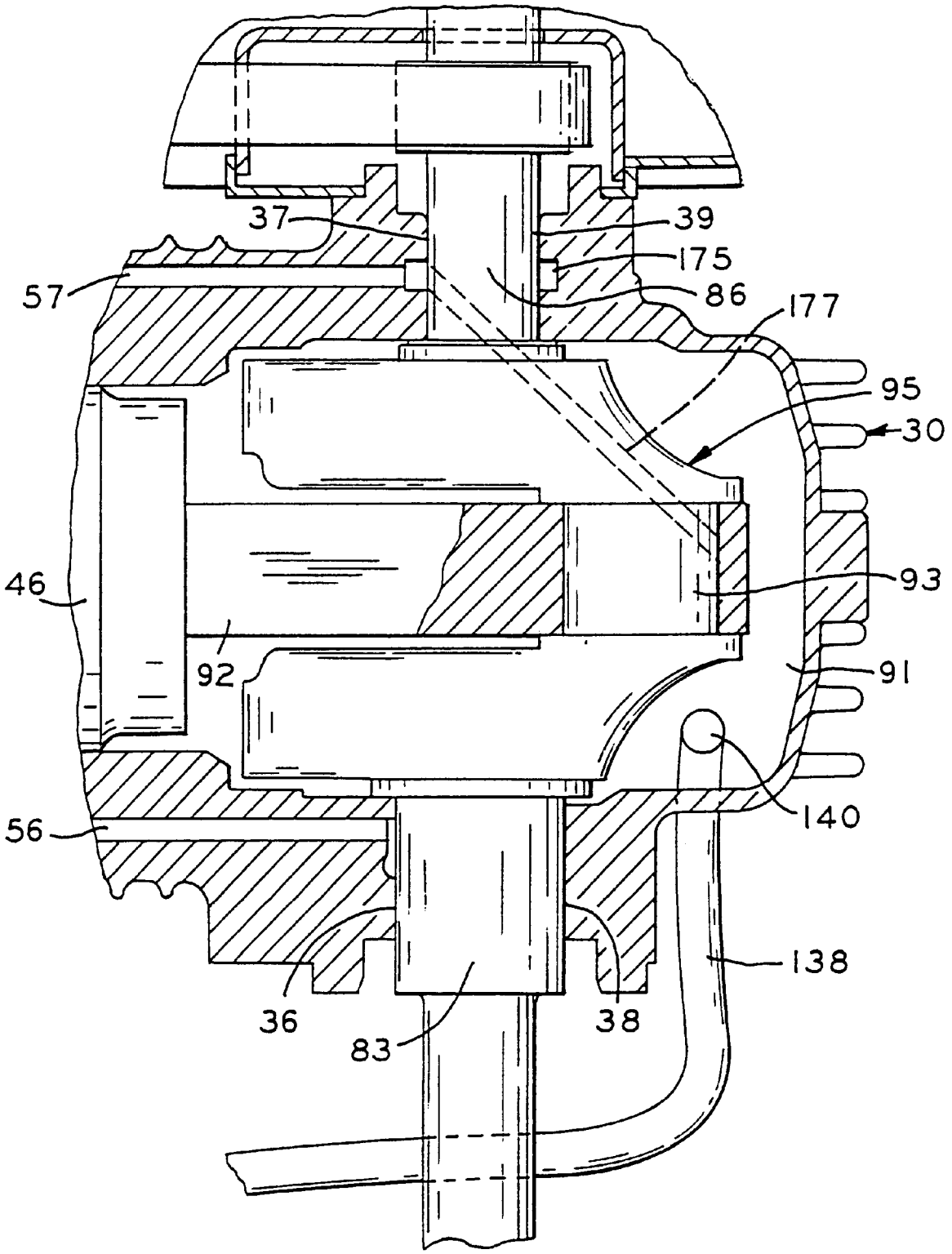
FIG. 9 is an enlarged view of that portion of the lubrication system shown in FIG. 1 utilized to lubricate the crankshaft region of the engine.

Referring now to FIG. 9, at its downstream end, oil conduit 56 terminates at bearing surface 36 to effect lubrication of crankshaft journal 83. For the vertical type crankshaft arrangement shown, journal 83 is further lubricated by the quantity of oil which falls to the bottom of cavity 91. Oil conduit 57 terminates at annular groove 175 formed in journal bearings 37, 39. Lubrication bore 177 drilled through counterweight/flywheel member 95 and journal 86 extends between annular groove 175 and the bearing surface between connecting rod 92 and crank pin 93. Annular groove 175 continuously communicates with bore 177 during crankshaft 42 rotation to provide uninterrupted pressurized lubrication for the bearing surface of connecting rod 92 throughout operation. Although not shown, an axial bore extending between the connecting rod bearing surface and the wrist pin for piston 46 may be provided to provide pressure lubrication for the wrist pin.

Figure 10:
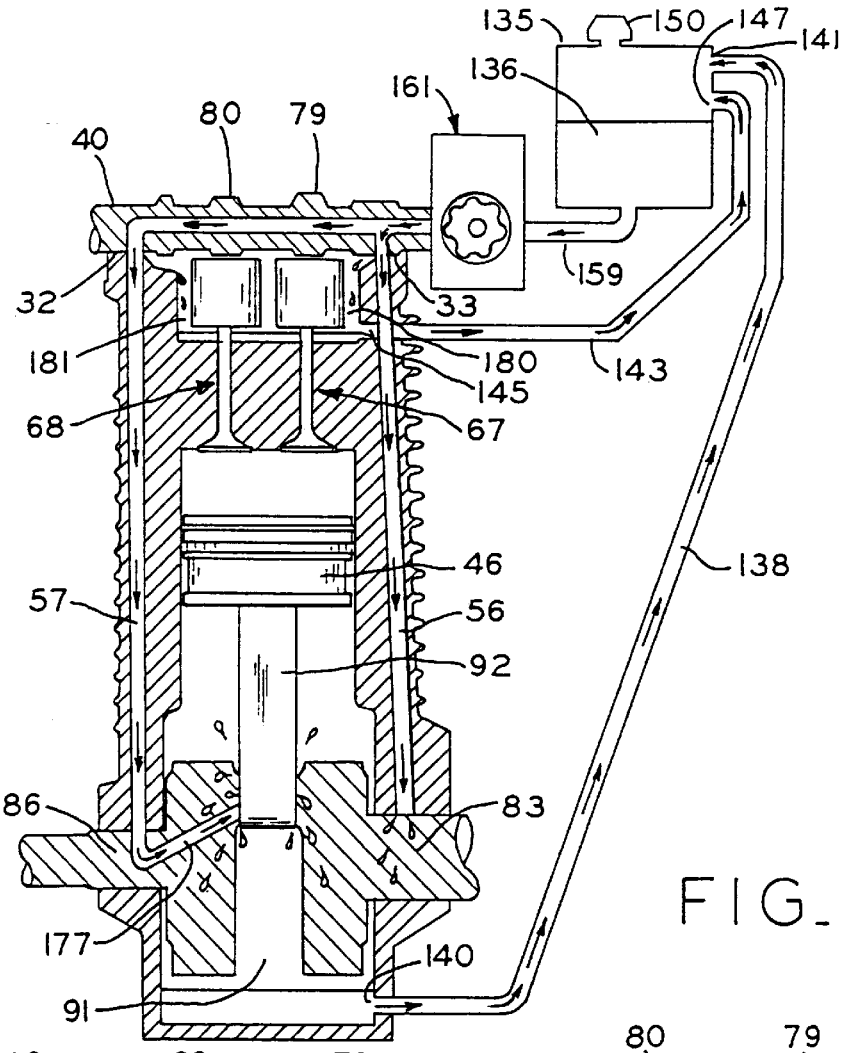
FIG. 10 is a diagrammatic view of the overall configuration and operation of one embodiment of the dry sump, pressurized lubrication system of the present invention.

The structure of the lubrication system of the present invention will be further understood in view of the following general explanation of its operation. This explanation refers to FIG. 10, which schematically shows an alternate orientation of the invention shown in FIG. 1 in that the crankshaft is horizontally disposed. It will be appreciated that still further modifications to the lubrication system can be performed within the scope of the invention. Lubricant 136 such as oil within external reservoir 135 is drawn through supply conduit 159 by pump 161 and introduced at high pressure into camshaft 40. Cross bores in camshaft 40 direct the oil to the journal bearings, such as bearings 32, 33 shown. The high oil pressure causes an overflow portion of the oil from both journal bearings to migrate axially inwardly and thereby lubricate the camshaft lobes 79, 80. Due to camshaft 40 rotation, the lubricating oil is also slung off camshaft 40 to splash lubricate the remainder of the surfaces and components within the cavity between cam cover 28 and cylinder head 24, including the portions of the valve assemblies represented at 67, 68 exposed within cavities 180, 181.

The remainder of the oil introduced at the journal bearings within grooves 172, 173 (See FIG. 8) is forced under positive pressure axially through conduits 56, 57 toward crankshaft 42. The oil is maintained cool during this travel time by the transfer of heat to the bosses 54, 55 which are exposed to passing cooling air. At its downstream end, conduit 56 includes an opening through which the conveyed oil is outlet to pressure lubricate shaft journal 83. Oil from conduit 57 outlets to lubricate shaft journal 86 as well as to fill annular groove 175 (See FIG. 9), and lubrication bore 177 routes pressurized oil from groove 175 to lubricate the connecting rod bearing surfaces. The overflow oil displaced from the pressure lubricated bearing surfaces by the arrival of additional oil is slung off crankshaft 42 to splash lubricate the moving components within crankcase cavity 91, such as piston 46, the piston rings, the wrist pin, the wrist pin bearings and the cylinder wall.

Figure 11A:
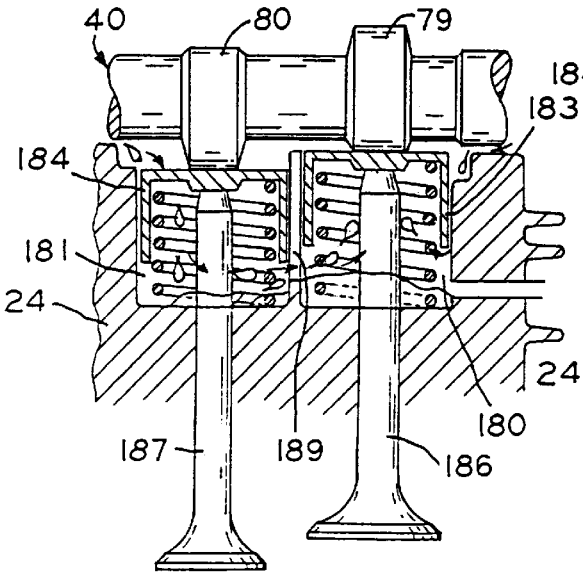
FIGS. 11A and 11B are enlarged diagrammatic views of the valve assemblies and the driving camshaft at two sequential stages of operation during which the alternating reciprocating motion of the valve assemblies pumps the oil introduced around the valve assemblies back to the external oil reservoir.
Figure 11B:
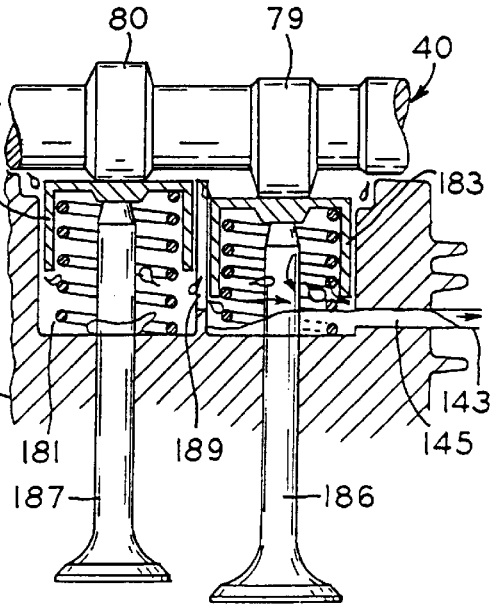

The circulation of the oil within engine 20 back to the external reservoir 135 is effected by positive displaement and/or pressure fluctuations caused by the reciprocating motion of the valve assemblies and piston. With additional reference to FIGS. 11A and 11B, which are enlarged, abstract views of the valve assemblies and the camshaft at sequential stages of engine operation, the oil which lubricates camshaft 40 and its associated valve assemblies 67, 68 accumulates in cavities 180, 181 provided in cylinder head 24. The spring-biased cam followers 183, 184, which in the shown embodiment are bucket-shaped tappets but could be otherwise configured, as well as the top of their associated valve stems 186, 187 reside within cavities 180, 181. Cam followers 183, 184 are tightly toleranced 30 to the dimensions of cavities 180, 181 to act as pistons to facilitate the following pumping operations. As camshaft 40 rotates, as shown in FIG. 11A, cam lobe 80 drives bucket tappet 184 downwardly, thereby reducing the effective volume of cavity 181 and creating a high positive pressure therein. This positive pressure forces the oil accumulated within cavity 181 to pass through slot 189 formed in valve head 24 between cavities 181, 180. Rather than an open-ended slot proximate camshaft 40, a bore or aperture could be substituted within the portion of cylinder head 24 between the cavities. As shown in FIG. 11B, as camshaft 40 continues to rotate cam follower 184 returns to its unengaged position and cam lobe 79 subsequently drives cam follower 183 downward to pressurize cavity 180. Outlet bore 145 in cylinder head 24 is provided with a larger cross-sectional area than slot 189 such that the path of least resistance for the oil accumulated within pressurized cavity 180 is through bore 145. Consequently, the positive pressure created within valve cavity 180 by the piston-like pumping action of valve assembly 67 forces the oil toward return conduit 143.

The oil in return conduit 143 is propelled in a step-wise fashion therethrough to oil reservoir 135. In particular, when a quantity of oil and air within valve assembly cavity 180 is forced into supply conduit 143, oil and air within the segment of conduit tubing adjacent inlet 147 is displaced and empties in a spurt into oil reservoir 135. The oil pumped into return conduit 143 for a particular valve assembly pumping stroke empties into oil reservoir 135 only after multiple additional pumping strokes have occurred, and the multiple is dependent in part upon the length of return conduit 143. Breather 150 allows air to be exhausted from within reservoir 135 such that a high pressure does not build up within reservoir 135 which would prevent oil pumping. Oil does not return into cavity 180 on the upstroke of valve assembly 67 because inlet 147 is above the oil level thus allowing only air to be drawn back out of reservoir 135. Thus, step-wise return of the oil to the oil return conduit and thus to the oil reservoir is effected by the positive pressure created by the pumping action of the valve assemblies.

Oil is returned from crankcase cavity 91 by exploiting the pumping action of piston 46. As piston 46 is driven downwardly within cylinder bore 44, the pressure in crankcase cavity 91 increases. This positive pressure forces a quantity of the lubricating oil and entrapped air within cavity 91 completely through oil return conduit 138 and into oil reservoir 135. Breather 150 achieves air venting of the volume of air which is blown through tubing 138 to prevent a pressure build-up. As piston 46 is driven upwardly within bore 44 to create a vacuum within crankcase cavity 91, air flows through breather 150, through the oil return conduit 138, and into crankcase cavity 91. Because port 141 is above the fluid level, the only oil reintroduced through conduit 138 into cavity 91 during the piston upstroke is any small quantity of oil in conduit 138 which failed to reach reservoir 135 during the piston downstroke.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A single cylinder overhead cam internal combustion engine comprising:

an engine housing including an integrally formed cylinder and cylinder head, said cylinder comprising an internal bore;

a crankshaft rotatably mounted within said engine housing, said crankshaft driving a drive sprocket located externally of said engine housing;

a piston operably connected to said crankshaft and mounted for reciprocation within said cylinder internal bore;

an overhead camshaft rotatably mounted within said engine housing and extending externally thereof, said camshaft comprising a camshaft sprocket located external of said engine housing;

a valve assembly in communication with said cylinder internal bore and operably connected with said camshaft; and an endless loop drive member interconnecting said drive sprocket and said camshaft sprocket for transmitting rotational motion therebetween, said drive member being external to said cylinder.

2. The internal combustion engine of claim 1 wherein said drive member comprises a flexible timing belt.

3. The internal combustion engine of claim 1 wherein said camshaft comprises a one-piece molding from one of thermosetting resin and a thermoplastic material.

4. The engine of claim 1 wherein said cylinder includes a wall segment along which said piston reciprocates, said wall segment having a uniform wall thickness.

* * * * *